US005176079A

United States Patent [19]

Pollich

[11] Patent Number: 5,176,079

[45] Date of Patent: Jan. 5, 1993

[54] DEVICE FOR CORRECTING THE REGISTER OF SHEET OVERPRINTS IN A SHEET-FED ROTARY PRINTING MACHINE

[75] Inventor: Gerhard Pollich, Heidelberg, Fed. Rep. of Germany

[73] Assignee: Heidelberger Druckmaschinen AG, Heidelberg, Fed. Rep. of Germany

[21] Appl. No.: 868,111

[22] Filed: Apr. 13, 1992

Related U.S. Application Data

[63] Continuation-in-part of Ser. No. 446,466, Dec. 4, 1989, abandoned.

[30] Foreign Application Priority Data

Dec. 3, 1988 [DE] Fed. Rep. of Germany ..... 3840870

[51] Int. Cl.[5] ..... B41F 21/05; B65H 9/12

[52] U.S. Cl. ..... 101/232; 101/410

[58] Field of Search ..... 101/409, 410, 411, 246, 101/232; 271/253, 254, 255, 268, 82

[56] References Cited

U.S. PATENT DOCUMENTS

| | | | |
|---|---|---|---|
| 2,577,099 | 12/1951 | Albrecht | 101/183 |
| 3,623,721 | 11/1971 | Smith | 271/254 |
| 3,682,472 | 8/1972 | Barthel | 271/254 |
| 3,833,213 | 9/1974 | Smith | 271/254 |
| 4,466,350 | 8/1984 | Schilling | 101/411 X |

*Primary Examiner*—J. Reed Fisher

*Attorney, Agent, or Firm*—Herbert L. Lerner; Laurence A. Greenberg

[57] ABSTRACT

Device for correcting the register of a sheet-overprint and for compensating for a distorted sheet in a sheet-fed rotary printing machine by deforming the leading edge of the sheet on a travel path thereof before the leading edge enters a printing unit, including an adjustable bending device for bending, in rhythm with a printing cycle of the machine, a support beam extending transversely to the travel path of the sheet and carrying a plurality of mutually adjacent sheet grippers, includes a pregripper device for executing swinging movements about a stationary axis and an axis adjustable into a given position, respectively, the pregripper device including a gripper fly forming the support beam for the sheet grippers, and respective rigid levers supporting the gripper fly at least at both ends thereof on a gripper-fly shaft, the bending device being cooperatively engageable with the pergripper device and being formed of a single adjustable deforming stop disposed substantially midway between the respective ends of the gripper fly and fixed to a frame of the machine, the bending device and theh pregripper device, except for the sheet gripper thereof, being located below the sheet travel path, the gripper fly, at a substantially midwise location thereof between the levers, being deformably engageable with the single adjustable deforming stop before the ends of the gripper fly, during a return swing thereof, have reached a zero setting in which the sheet grippers take over a sheet.

10 Claims, 4 Drawing Sheets

2
8
X1
22
31
30
29
28
21
24
25
10
23
26
27

DEVICE FOR CORRECTING THE REGISTER OF SHEET OVERPRINTS IN A SHEET-FED ROTARY PRINTING MACHINE

CROSS-REFERENCE TO RELATED APPLICATION

This application is a Continuation-In-Part of Ser. No. 446,466, filed Dec. 4, 1989, now abandoned.

The invention relates to a device for correcting the register of a sheet overprint and for compensating for a distorted sheet in a sheet-fed rotary printing machine by deforming the leading edge of the sheet on a travel path thereof before the leading edge enters a printing unit, including an adjustable bending device for bending, in rhythm with a printing cycle of the machine, a support beam extending transversely to the travel path of the sheet and carrying a plurality of mutually adjacent sheet grippers.

These generic features of a device for correcting register and for compensating for distorted sheets have become known heretofore from U.S. Pat. No. 4,466,350 wherein a sheet transfer cylinder provided with these features is described. A bending device engages the middle of a gripper-fly shaft of a sheet transfer cylinder so that it bends the gripper-fly shaft in rhythm with the operating cycle of the machine. The leading edge of a sheet is thereby deformed in the middle thereof in or opposite to the direction of rotation of the cylinder. The bending device is formed of a movable arrangement of a middle gripper-fly shaft bearing and a cam mechanism including a cam roller and a restoring or return spring, the cam roller having an instantaneous position of rotation adjustable by a control shaft which, in accordance with the suggestion in the aforementioned patent, is formed by the gripper-fly shaft. Relatively high costs are entailed in providing such a bending device. Above all, such a bending device is disadvantageous in that an adjustment in the deformation of the leading edge of the sheet cannot be effected during the operation of the machine, so that it is necessary to stop the machine repeatedly in the make-ready phase in order to perform register corrections by deforming the leading edge of the sheet.

U.S. Pat. No. 2,577,099 shows a register-correcting device wherein the gripper-bridge or fly shaft is firmly held at the ends thereof in a sheet transfer cylinder, and is also bent in the middle thereof either in or opposite the direction of travel of the sheet. In this regard, the gripper-bridge shaft is of tubular construction and is supported on a pair of rollers in the middle of a channel formed in the sheet transfer cylinder, the pair of rollers having axes of rotation which assume varying angular positions with respect to the axis of the gripper-bridge shaft the rollers of the pair thereof being pressable individually against the gripper-bridge shaft, by means of an eccentric mechanism or formed as a bending or flexure rod which is directly deformable by an eccentric mechanism. Such a control mechanism for the bending device is also quite costly and is, above all, not controllable during operation of the machine.

In German Prosecuted Application (DE-AS) 23 14 302 and German Patent 11 75 695, devices for deforming the leading edge of a sheet for the purpose of effecting a register correction are described wherein the gripper-fly or bridge shaft is subdivided, and the adjacent ends of the shaft portions are mounted in a movable slide which is adjustable by means of specific structural members. These devices, as well, are non-economical and are not adjustable during operation of the machine.

Reference is also made to the heretoforeknown possibility of adjusting gripper pad bars and front stops, respectively, which are provided in the grippers of sheet transfer cylinders for the purpose of deforming the leading edge of a sheet, in accordance with German Patent 1,909,795 and German Published Non-Prosecuted Application DE-OS 35 04 435. With the devices known therefrom, the leading edge of a sheet is already deformed during the alignment thereof at the gripper pad bar and at the front stops, respectively, of the grippers in a sheet feeding cylinder, and thereby brought to a smooth or uniform abutment thereat.

These heretofore known means which are formed differently from the initially described state of the art do not, however, eliminate the aforementioned disadvantages.

All of the devices according to the state of the art exhibit a common feature, namely, that the means for deforming the leading edge of the sheet are arranged on a rotatingly driven cylinder, with a gripper system disposed in an axial channel formed at the peripheral surface of this cylinder and swingable about a gripper-fly shaft mounted eccentrically to the cylinder axis. Thus, practice and the literature clearly indicate a direction towards limiting the construction of such means to rotating cylinders and a necessity for accepting a costly production without having any possibility of performing a simple adjustment of the means during the operation of the machine.

It is accordingly an object of the invention to provide a bending device for deforming the leading edge of a sheet for the purpose of correcting the register and for compensating for distorted or stressed sheets, respectively, in a gripper system for taking over sheets in a sheet-fed rotary printing machine, which is primarily adjustable during operation of the machine, and requires a least possible number of additional structural members.

With the foregoing and other objects in view, there is provided, in accordance with the invention, a device for correcting the register of a sheet-overprint and for compensating for a distorted sheet in a sheet-fed rotary printing machine by deforming the leading edge of the sheet on a travel path thereof before the leading edge enters a printing unit, including an adjustable bending device for bending, in rhythm with a printing cycle of the machine, a support beam extending transversely to the travel path of the sheet and carrying a plurality of mutually adjacent sheet grippers, comprising a pregripper device for executing swinging movements about a stationary axis and an axis adjustable into a given position, respectively, the pregripper device including a gripper fly forming the support beam for the sheet grippers, and respective rigid levers supporting the gripper fly at least at both ends thereof on a gripper-fly shaft, the bending device being cooperatively engageable with the pregripper device and being formed of at least one adjustable stop fixed to a frame of the machine, the gripper fly, at a substantially midwise location thereof between the levers, being engageable with the one adjustable stop before the ends of the gripper fly, during a return swing thereof, have reached a zero setting in which the sheet grippers take over a sheet.

An essential feature which distinguishes the invention over the state of the art is thus the construction of the bending device at the gripper fly or bridge of a pregripper device which executes swinging movements about an axis which is stationary with respect to the machine frame yet possibly adjustable in the position thereof, the gripper fly thereof being supported only at both ends thereof by means of rigid i.e. stiff against flexure, levers on a gripper-fly shaft. The bending device per se is formed then only of a stop which is fixed to the machine frame yet is able to be adjusted in height, and is engageable by the gripper fly at a middle location thereof before the ends of the gripper fly, during a return swing thereof, have reached a zero setting thereof in which the sheet grippers take over a sheet. Because the stop is disposed on a part of the machine frame, it is adjustable at any time, even when the machine is in operation. This constitutes an essential advantage of the device according to the invention of the instant application over all of the constructions of the prior art described hereinbefore. Moreover, the stop, in its simplest form, may be constructed as or on an adjusting screw or setscrew which is screwed into a thread formed in a member fixed to the machine frame. End stops for the gripper fly are generally unnecessary, however, stops may also be provided on the machine frame for the ends of the gripper fly, the stops being engageable, if necessary or desirable, by the gripper fly in the zero setting thereof. If the middle stop for the gripper fly is withdrawn behind a rectilinear connection line between the two end stops, the bending device is ineffective. If a register correction should be necessary, the middle stop is shifted with respect to the rectilinear connection line so that the middle of the gripper fly engages the middle stop before the ends of the gripper fly reach the zero setting thereof and the outer stops, respectively, so that the gripper fly is slightly bent around the middle stop. Such a gripper fly operates with gripper pad bars so that when the bending device is adjusted, the sheet projects farther into the grippers at the ends of the gripper fly than in the middle thereof and, initially, for the purpose of tensioning the sheet during motion of the pregripper device, the lateral sides of the sheet are accelerated to a greater extent than in the middle, as in the case of other hereinaformentioned conventional devices.

In its simplest construction and, in accordance with another feature of the invention, the one adjustable stop for the gripper fly is disposed on a crossbar of the machine frame.

In accordance with an added feature of the invention, the one adjustable stop is formed on a setscrew threadedly secured on the crossbar.

In accordance with an additional feature of the invention, there are provided additional stops fixed to the machine frame for engaging the ends of the gripper fly on a rectilinear connecting line, the one adjustable stop being adjustable in a travel direction of the sheet along the travel path thereof so as to project beyond the rectilinear connecting line.

In accordance with a further feature of the invention, the additional stops are adjustable.

In accordance with another conceivable embodiment of the invention, the middle stop for the gripper fly is supported on the gripper-fly shaft in order to permit a delay of several degrees of swing. In this regard, in accordance with yet another feature of the invention, the one adjustable stop is formed as a roller braced against the gripper-fly shaft and adjustable in spacing from the axis of the gripper-fly shaft.

In accordance with further features of this embodiment, the register-correcting device includes another lever firmly connected at an end thereof to the gripper fly and extending substantially parallel to and midwise between the rigid levers disposed at the ends of the gripper fly, the other lever at the other end thereof having a self-aligning bearing disposed eccentrically to the axis of the gripper-fly shaft and connected to the gripper-fly shaft so as to be fixed against rotation relative thereto, the roller forming the one adjustable stop being mounted on the other lever.

In accordance with yet an added feature of the invention, there is provided a ring turnably mounted on the gripper-fly shaft, a cam formed at the periphery of the ring, the roller forming the one adjustable stop being engageable with the cam and adjustable thereby in spacing from the gripper-fly shaft.

In accordance with yet an additional feature of the invention, the register-correcting device provides an adjusting screw secured to the machine frame so as to be fixed against displacement in axial direction, the ring being connected to the adjusting screw.

In accordance with a concomitant feature of the invention, the register-correcting device includes a stop lever fixed to the machine frame and adjustable to a tension-free zero setting of the gripper fly, the other lever being cooperatively engageable with the stop lever.

When the device is disengaged, the roller remains free, and the lever is pressed against the contact screw by a spring.

Other features which are considered as characteristic for the invention are set forth in the appended claims.

Although the invention is illustrated and described herein as embodied in a device for correcting the register of sheet overprints in a sheet-fed rotary printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
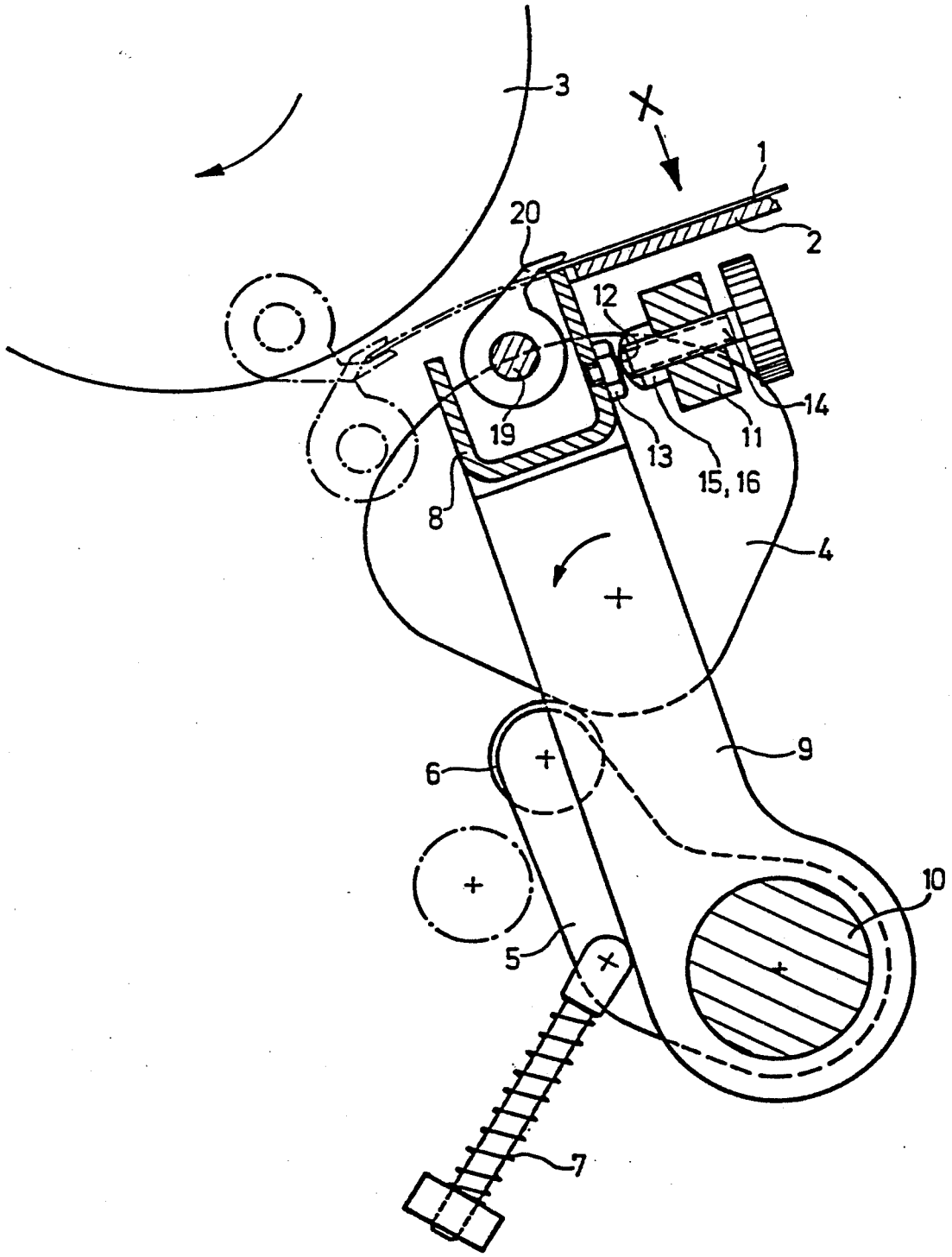
FIG. 1 is a diagrammatic vertical sectional view of a pregripper device of a sheet-fed rotary printing machine.
Figure 2:
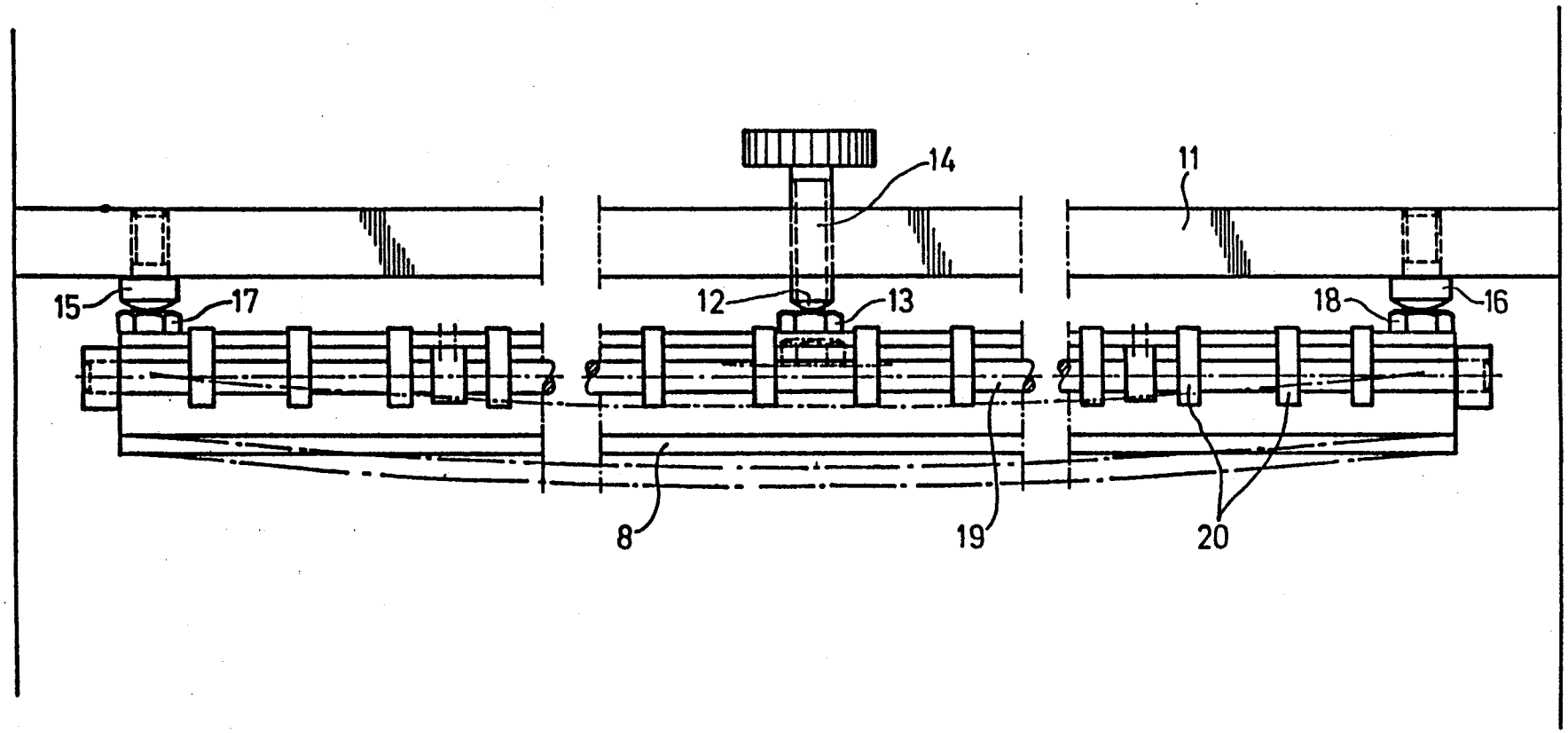
FIG. 2 is a view of the pregripper device of FIG. 1 as seen in the direction of the arrow X.

Referring now to the figures of the drawing and, first, particularly to FIG. 1 thereof, there is shown therein a pregripper device which takes over a sheet 1, which is to be printed, from a feed table 2 whereon the sheet has been aligned at non-illustrated front and side lays. The pregripper device accelerates the travel of the sheet 1 to printing speed and transfers it to a transfer cylinder 3. The pregripper device is driven by a cam 4 shown in FIG. 1, via a roller lever 5 having a roller 6 rotatably mounted on a free end thereof and being forced by a spring 7 against the cam 4. By suitably designing the cam 4, the sheet 1 is accelerated to printing speed by the device as the sheet 1 is being transferred to the cylinder 3, while the pregripper device after a suitable delay in the last phase of motion, slowly returns to its starting or zero position in which it takes over a new sheet from the delivery table 2. In the embodiment illustrated in FIGS. 1 and 2, a gripper bridge or fly 8, which extends across the width of the machine and has a U-shaped cross section, is fastened at the ends thereof to respective ends of levers 9 which are resistant to bending, the levers 9 being, in turn, fastened at the respective opposite ends thereof to a rocking shaft 10 of the pregripper device. A device for bending the gripper fly 8, in accordance with the invention, is made up of a stop 12 adjustably disposed on a crossbar 11 of a frame of the machine and cooperating with an opposing or counter-stop 13 located on the gripper fly 8. In the embodiment illustrated in FIGS. 1 and 2, the stop 12 is formed on an adjusting screw or setscrew 14 which can be screwed into the transversely extending crossbar 11 or another structural member of the machine frame, the setscrew 14 having a free end formed with a knurled head or other means for applying or connecting a tool or motor thereto. Further necessarily or desirably adjustable stops 15 and 16 are provided in the vicinity of the ends of the gripper fly 8 and cooperate with respective counter-stops 17 and 18 on the gripper fly 8. In their simplest form, the stops 15 and 16 are "mushroom heads", and the counter-stops 17 and 18 are formed on adjusting screws or setscrews. In this arrangement or embodiment of the inventive device, the stop 12 can be withdrawn by its setscrew 14 to a location behind a non-illustrated rectilinear connecting line which extends through planes of contact of the stops 15 and 16, on the one hand, with the counter-stops 17 and 18, on the other hand, so that no bending of the gripper fly 8 occurs. For the purpose of effecting a register correction, the stop 12 can be advanced beyond this non-illustrated rectilinear connection line, while the machine is in operation, by suitably actuating or manipulating the setscrew 14 so that bending of the gripper fly 8 to a greater or lesser extent is effected, as is indicated in phantom in FIG. 2. Depending upon the extent of bending, grippers 20 in the gripper fly 8, which are movable about a swivel axis 19 of the gripper fly 8, extend farther into the sheet 1 at the lateral edges thereof than the grippers 20 in the middle of the gripper fly 8, so that, during the movement of the pregripper device, a greater acceleration of the sheet 1 occurs at the lateral edges of the sheet 1 than at the middle thereof, with a consequent tensioning of the sheet 1.

As is readily apparent from FIG. 1, the sheet 1 is fed along a travel path over the feed table 2 and is intercepted by the pregripper device which includes the grippers 20, the gripper fly 8, the levers 9, the rocking shaft 10 and the cam 4, all of which, except for the gripping portion of the grippers 8, are located below the sheet travel path and the feed table 2. Furthermore, the bending device formed of the crossbar 11, the deforming stop 12 and the end stops 15 and 16 engaging the counterstops 17 and 18 provided on the gripper fly 8 is also located below the sheet travel path and the feed table 2. Thus, before the sheet 1 actually enters the printing unit represented by the transfer cylinder 3, the register thereof is corrected, and distortions therein are compensated for by deforming the leading edge thereof by means of the device according to the invention. By locating the pregripper device and the bending device below the sheet travel path and the feed table, the pressman has an unobstructed view of the traveling sheet 1 before it enters the printing unit.

Figure 3:
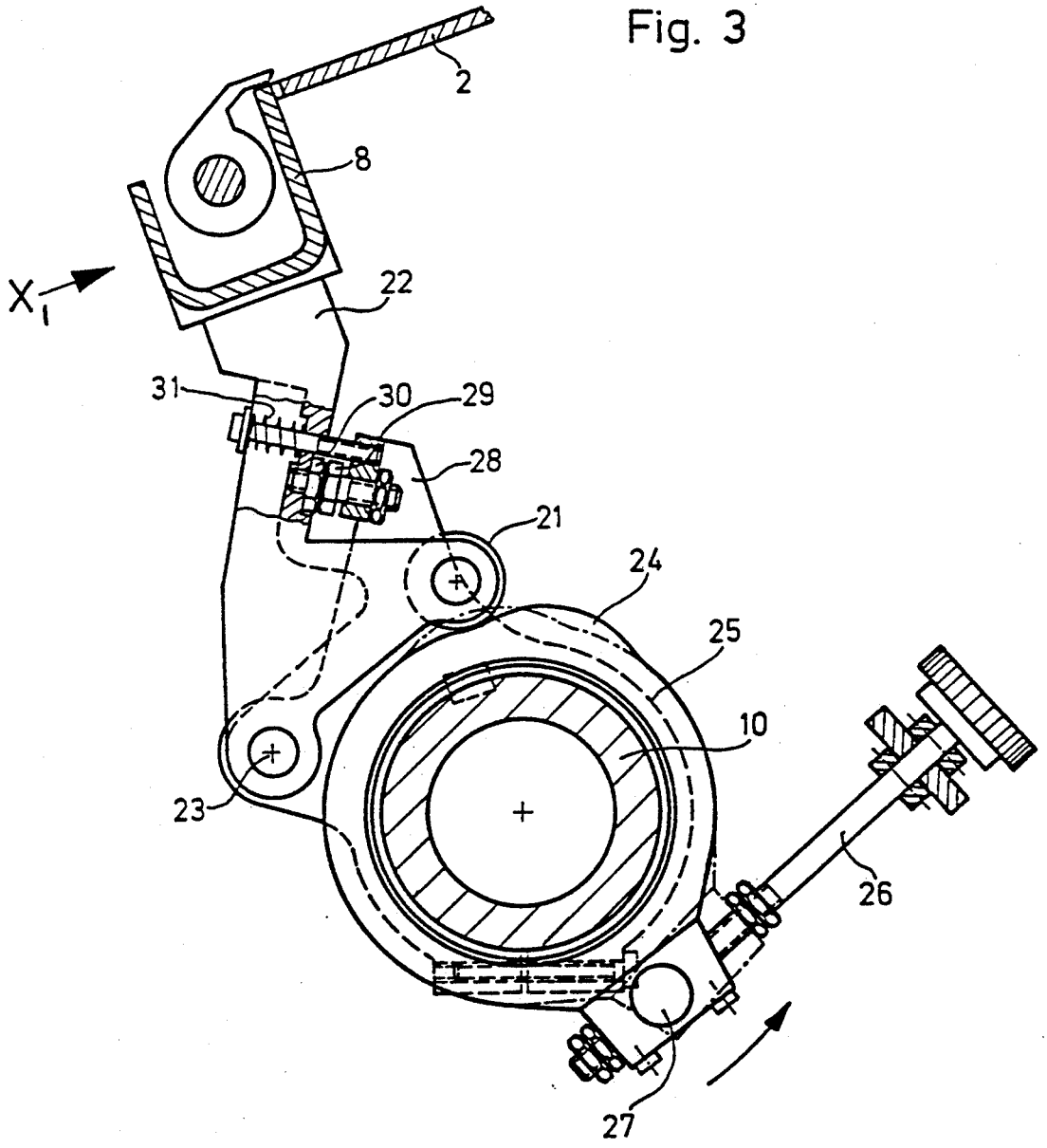
FIG. 3 is a view similar to that of FIG. 1 of another embodiment of the pregripper device.
Figure 4:
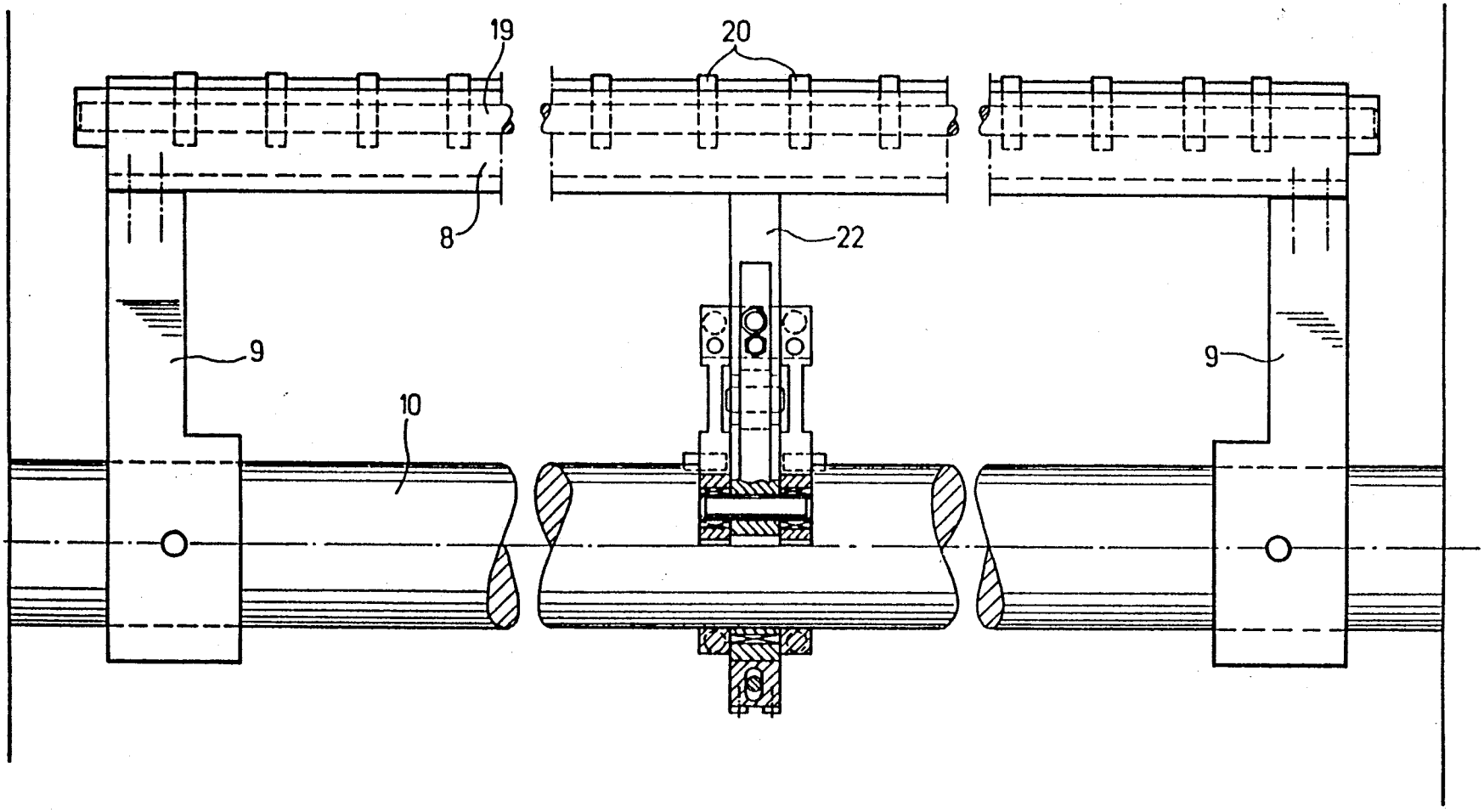
FIG. 4 is a view of the pregripper embodiment of FIG. 3 as seen in the direction of the arrow $X_1$.

Another embodiment of the device for correcting the register of sheet overprints in a sheet-fed rotary printing machine according to the invention is illustrated in FIGS. 3 and 4. In this embodiment, the stop is formed of a roller 21 which is braced by a spring 31 against a cam 24 and freely rotatably mounted on a further lever 22, which is disposed midwise between the ends of the gripper fly 8 somewhat parallel to the two levers 9, resistant to bending, which are shown in FIG. 4. One end of the lever 22 is firmly connected to the gripper fly 8, and the other end thereof has a self-aligning bearing 23 thereon which is connected to the shaft 10 of the gripper fly 8 eccentrically to the axis of the shaft 10 and so as to be fixed against relative rotation therewith. Because the roller 21 is adjustable in its spacing from the axis of the gripper-fly shaft 10, a bending device is formed by means of which the gripper fly 8 can be deformed via the lever 22. For the purpose of adjusting the spacing of the roller 21 from the axis of the gripper-fly shaft 10, a cam 24 is provided in the embodiment of FIGS. 3 and 4, which is formed at the periphery of a ring 25 which is turnable about the axis of the gripper-fly shaft 10. This ring 25 is turnable by a setscrew 26 which is held in the machine frame in a manner so as not to be axially displaceable, the setscrew 26 having a nut 27 threaded therein which is connected oscillatingly displaceably with the ring 25. By means of the setscrew 26, the cam 24 can be turned into the range of the roller 21 serving as a stop, so that the roller 21, when the gripper fly 8 swings back, comes to a stop earlier, and the gripper fly 8 thereby becomes deformed. To stop or inactivate the bending device, the cam 24 is moved out of the range of motion of the roller 21, as is illustrated in FIG. 3. The lever 22 which is connected to the middle of the gripper fly 8 cooperates with another stop lever 28 which is mounted on the gripper-fly shaft 10 so as to be fixed against relative rotation therewith. A respective adjustable stop screw 29 and 30 are provided on the lever 29 and the lever 22, the stop screw 29 and 30 having respective heads by which they are in contact with one another and by which they are adjustable or settable to a tension-free zero setting of the gripper fly 8. When the bending device is stopped or inactive, both heads, respectively, of the screws 29 and 30 are held together by a spring 31.

I claim:

1. Device for correcting the register of a sheet-overprint and for compensating for a distorted sheet in a sheet-fed rotary printing machine by deforming the leading edge of the sheet on a travel path thereof before the leading edge enters a printing unit, including an adjustable bending device for bending, in rhythm with a printing cycle of the machine, a support beam extending transversely to the travel path of the sheet and carrying a plurality of mutually adjacent sheet grippers, comprising a pregripper device for executing swinging movements about a stationary axis and an axis adjustable into a given position, respectively, said pregripper device including a gripper fly forming the support beam for the sheet grippers, and respective rigid levers supporting said gripper fly at least at both ends thereof on a gripper-fly shaft, the bending device being cooperatively engageable with said pregripper device and being formed of a single adjustable deforming stop disposed substantially midway between the respective ends of said gripper fly and fixed to a frame of the machine, the bending device and said pregripper device, except for the sheet gripper thereof, being located below the sheet travel path, said gripper fly, at a substantially midwise location thereof between said levers, being deformably engageable with said single adjustable deforming stop before said ends of said gripper fly, during a return swing thereof, have reached a zero setting in which the sheet grippers take over a sheet.

2. Register-correcting device according to claim 1, wherein said single adjustable deforming stop for said gripper fly is disposed on a crossbar of the machine frame.

3. Register-correcting device according to claim 2, wherein said single adjustable deforming stop is formed on a setscrew threadedly secured on said crossbar.

4. Register-correcting device according to claim 1, including additional stops fixed to the machine frame for engaging said ends of said gripper fly on a rectilinear connecting line, said single adjustable deforming stop being adjustable in a travel direction of the sheet along said travel path thereof so as to project beyond said rectilinear connecting line.

5. Register-correcting device according to claim 4, wherein said additional stops are adjustable to positions on said rectilinear connecting line.

6. Register-correcting device according to claim 1, wherein said one adjustable stop is formed as a roller braced against said gripper-fly shaft and adjustable in spacing from the axis of said gripper-fly shaft.

7. Register-correcting device according to claim 6, including another lever firmly connected at an end thereof to said gripper fly and extending substantially parallel to and midwise between said rigid levers disposed at said ends of said gripper fly, said other lever at the other end thereof having a self-aligning bearing disposed eccentrically to said axis of said gripper-fly shaft and connected to said gripper-fly shaft so as to be fixed against rotation relative thereto, said roller forming said one adjustable stop being mounted on said other lever.

8. Register-correcting device according to claim 6, including a ring turnably mounted on said gripper-fly shaft, a cam formed at the periphery of said ring, said roller forming said one adjustable stop being engageable with said cam and adjustable thereby in spacing from said gripper-fly shaft.

9. Register-correcting device according to claim 8, including an adjusting screw secured to the machine frame so as to be fixed against displacement in axial direction, said ring being connected to said adjusting screw.

10. Register-correcting device according to claim 7, including a stop lever fixed to the machine frame and adjustable to a tension-free zero setting of said gripper fly, said other lever being cooperatively engageable with said stop lever.

* * * * *